US007685910B2

(12) United States Patent
Kennedy

(10) Patent No.: US 7,685,910 B2
(45) Date of Patent: Mar. 30, 2010

(54) REVERSIBLE TORQUE BACK-UP TONG

(75) Inventor: Charles Robert Kennedy, Ventura, CA (US)

(73) Assignee: Westco International, Inc., Ventura, CA (US)

( * ) Notice: Subject to any disclaimer, the term of this patent is extended or adjusted under 35 U.S.C. 154(b) by 0 days.

(21) Appl. No.: 12/047,196

(22) Filed: Mar. 12, 2008

(65) Prior Publication Data

US 2009/0229422 A1 Sep. 17, 2009

(51) Int. Cl.
*B25B 17/00* (2006.01)

(52) U.S. Cl. ..... 81/57.16; 81/57.15; 81/57.17; 81/57.19

(58) Field of Classification Search ..... 81/57.15, 81/57.16, 57.17, 57.19
See application file for complete search history.

(56) References Cited

U.S. PATENT DOCUMENTS

| | | | | |
|---|---|---|---|---|
| 3,025,733 | A * | 3/1962 | Soodnizin | 81/57.16 |
| 4,326,435 | A * | 4/1982 | Guillot et al. | 81/57.34 |
| 5,823,074 | A * | 10/1998 | Ahlstone | 81/57.34 |
| 7,000,503 | B2 * | 2/2006 | Dagenais et al. | 81/57.35 |

* cited by examiner

*Primary Examiner*—Joseph J Hail, III
*Assistant Examiner*—Shantese McDonald
(74) *Attorney, Agent, or Firm*—The Eclipse Group LLP

(57) ABSTRACT

A back-up tong for assembling or disassembling threaded joints of tubing for use in oil and gas wells is provided. The back-up tong has both a first and second gripping mechanism. The first gripping mechanism has a plurality of jaws for engaging the tubing to prevent rotation of the tubing in a clockwise direction and the second gripping mechanism has a plurality of jaws for engaging the tubing to prevent rotation of the tubing in a counter-clockwise direction.

11 Claims, 9 Drawing Sheets

REVERSIBLE TORQUE BACK-UP TONG

BACKGROUND OF THE INVENTION

1. Field of the Invention

The invention relates to a back-up tong of the type used in conjunction with a power tong to assemble or disassemble threaded joint connections between successive tubing sections that form the continuous tubing string extending through a well bore into underground deposits. More particularly this invention relates to a back-up tong that provides opposing reactive force to the torque of a power tong without rotating the back-up tong one-hundred eighty (180) degrees when the rotation of the power tong is reversed.

2. Related Art

To interconnect and disconnect tubing that is lowered into oil or gas production wells, two types of tongs are typically utilized to make or break the threaded joint connections between successive tubing sections. The ends of each tubing section are threaded with a male screw thread at one end and a female screw thread at an opposite end. As each tube section is lowered into the well bore, a successive section is screwed to its upper end. Power tongs apply torque to the upper tubing of the joint, while a back-up tong applies opposing torque to the lower tubing of the joint. In this manner, the back-up tong reacts against the torque applied by the power tong to the upper tubing of the joint, as such, the back-up tong keeps the bottom tubing of the joint from rotating when the power tong applies torque to the upper tubing to connect or disconnect threaded joint connections between tubing sections.

Today, power/back-up tong combination devices, such as the tong combination device 100 illustrated in prior art FIG. 1, are utilized to assemble and disassemble threaded joint connections between successive tubing sections that form the continuous tubing string extending through a well bore into underground deposits. As illustrated in FIG. 1, a back-up tong 102 is generally suspended from a power tong 104, so that the reaction torque of one tong is cancelled by the other tong, which eliminates the need to anchor the tongs to the oil rig. Instead, the tong combination device 100 is suspended by a hoist over the well bore. In such arrangements, the tail end 106 of the back-up tong 102 attaches to a structural support 108 on the back end of the power tong 104.

Current designs also feature a swivel and hinge mounting of the back-up tong 102 that allows the back-up tong 102 to be lowered away from the power tong 104 to permit rotation of the back-up tong 102 by one-hundred eighty (180) degrees in relation to the tubing being assembled. The jaws of current back-up tongs 102 only apply torque in one opposing rotational direction. To provide appropriate reactive force to the torque of the power tong 104, the back-up tong 102 must be flipped over according to the direction of rotation of the power tong 104. Accordingly, if rotation must be reversed, for example, from assembling tubing sections to disassembling the tubing sections, the power tong 104 and back-up tong 102 are removed from the tubing connection area and the power tong 104 is adjusted to perform the opposite rotation. The back-up tong 102 is then rotated upside down to react to the reversed torque of the power tong 104 on the tubing T.

An example of a current back-up tong 102 generally used in a power/back-up tong combination device 100, such as the device illustrated in FIG. 1, is described in U.S. Pat. No. 5,823,074 and illustrated in FIG. 2. FIG. 2 illustrates a top view of an open-head Foster-style back-up tong 200 having three pivoting jaws 202 in mesh connection with a ring gear 204. A drive cylinder 206 powered by a hydraulic motor engages the outer circumference of the ring gear 204. As illustrated in FIG. 3, rotation of the ring gear 204 in one direction causes each of the jaws 202 to pivot toward the center of the ring gear 204 and grip any tubing placed in the center opening of the back-up tong 200.

While the open-head Foster-style back-up tongs 200 work well, such back-up tongs still require more than one individual to operate. The current open-head Foster-style back-up tongs, of the type illustrated in FIGS. 2-3, only apply torque in one opposing rotational direction. Thus, current back-up tongs still require rotation to provide appropriate reactive force to the torque of the power tong when the rotation of the power tong is reversed.

Accordingly, a need exists for a back-up tong that can provide reactive force to the torque of the power tong when rotation of the power tong is reversed without requiring the back-up tong to be rotated one-hundred and eighty (180) degrees. In other words, a need exists for a back-up tong capable of gripping a pipe for assembling and disassembling pipe joints without rotating the back-up tong (i.e., reversing the back-up tong by turning the back-up tong upside down).

SUMMARY

A back-up tong for assembling or disassembling threaded joints of tubing for use in oil and gas wells is provided. The back-up tong has both a first and second gripping mechanism. The first gripping mechanism has a plurality of jaws for engaging the tubing to prevent rotation of the tubing in a clockwise direction and the second gripping mechanism has a plurality of jaws for engaging the tubing to prevent rotation of the tubing in a counter-clockwise direction. Accordingly, a back-up tong is provided that is capable of providing opposing reactive forces to the torque of a power tong without requiring rotation of the back-up tong one-hundred eighty (180) degrees when the rotation of the power tong is reversed.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 4:
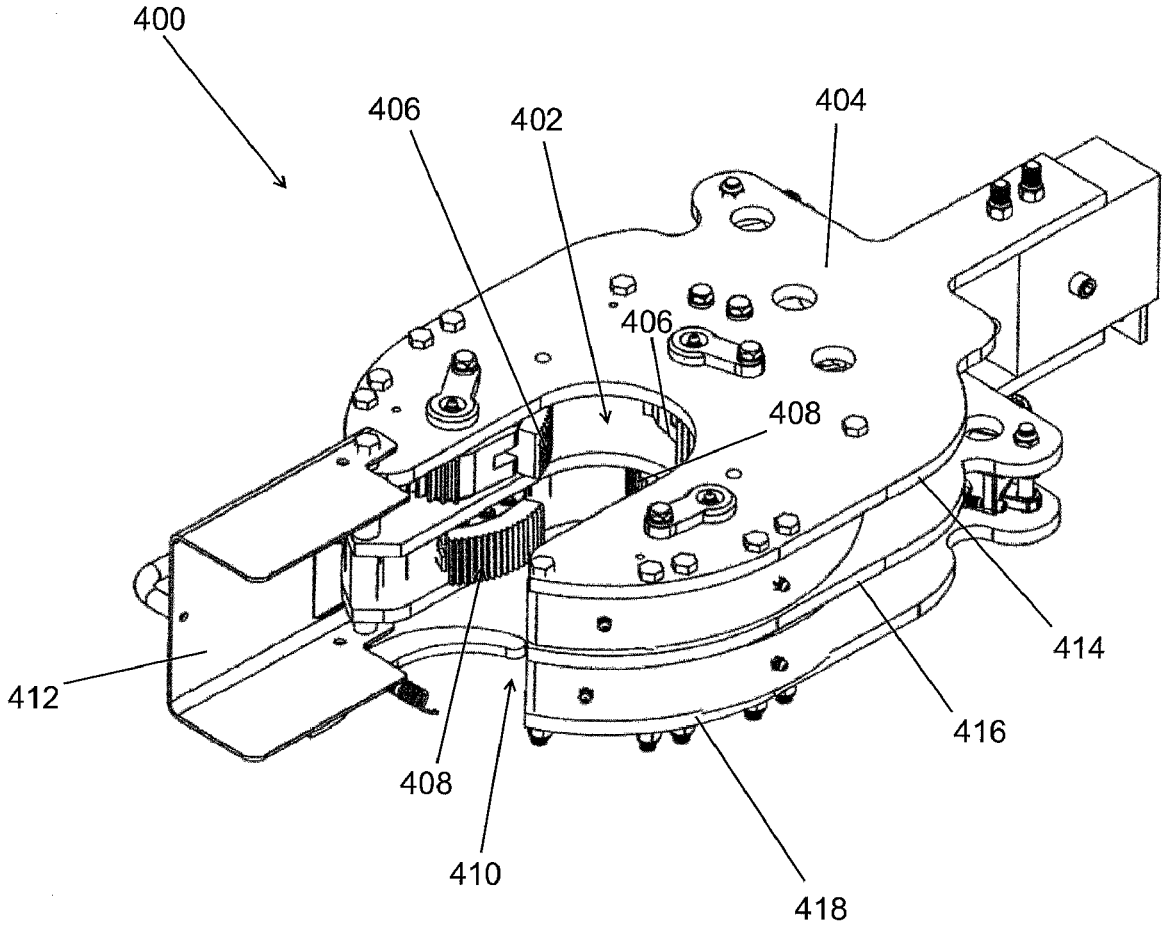
FIG. 4 is a perspective view of one example of an implementation of a reversible torque open head back-up tong.

FIGS. 4-10 illustrate one example of an implementation of a back-up tong 400 that is capable of reversing the direction of the torque applied by the back-up tong 400 without physically rotating the back-up tong 400. In particular, FIG. 4 is a perspective view of one example of an implementation of a reversible torque open head back-up tong 400. As illustrated in FIG. 4, the back-up tong 400 has a through bore 402 and a tong head 404 that contains two sets, i.e., an upper set and a lower set, of actuated gripping mechanisms 406 and 408. The back-up tong 400 is of an open head configuration, having a radial slot 410 extending from the through bore 402 to the outside of the tong head 404. The radial slot 410 permits tubing T to be admitted laterally, i.e. in a radial direction, into the through bore 402. A hinged latch 412 closes the radial slot 410 for safety.

Further, the back-up tong 400 has three generally planar plates: a top plate 414, an intermediate plate 416 and a bottom plate 418. The plates 414, 416 and 418 are spaced apart in substantially parallel relationship to one another, where the upper gripping mechanism 406 is positioned between the top plate 414 and the intermediate plate 416, and the lower gripping mechanism 408 is positioned between the intermediate plate 416 and the bottom plate 418.

Figure 5:
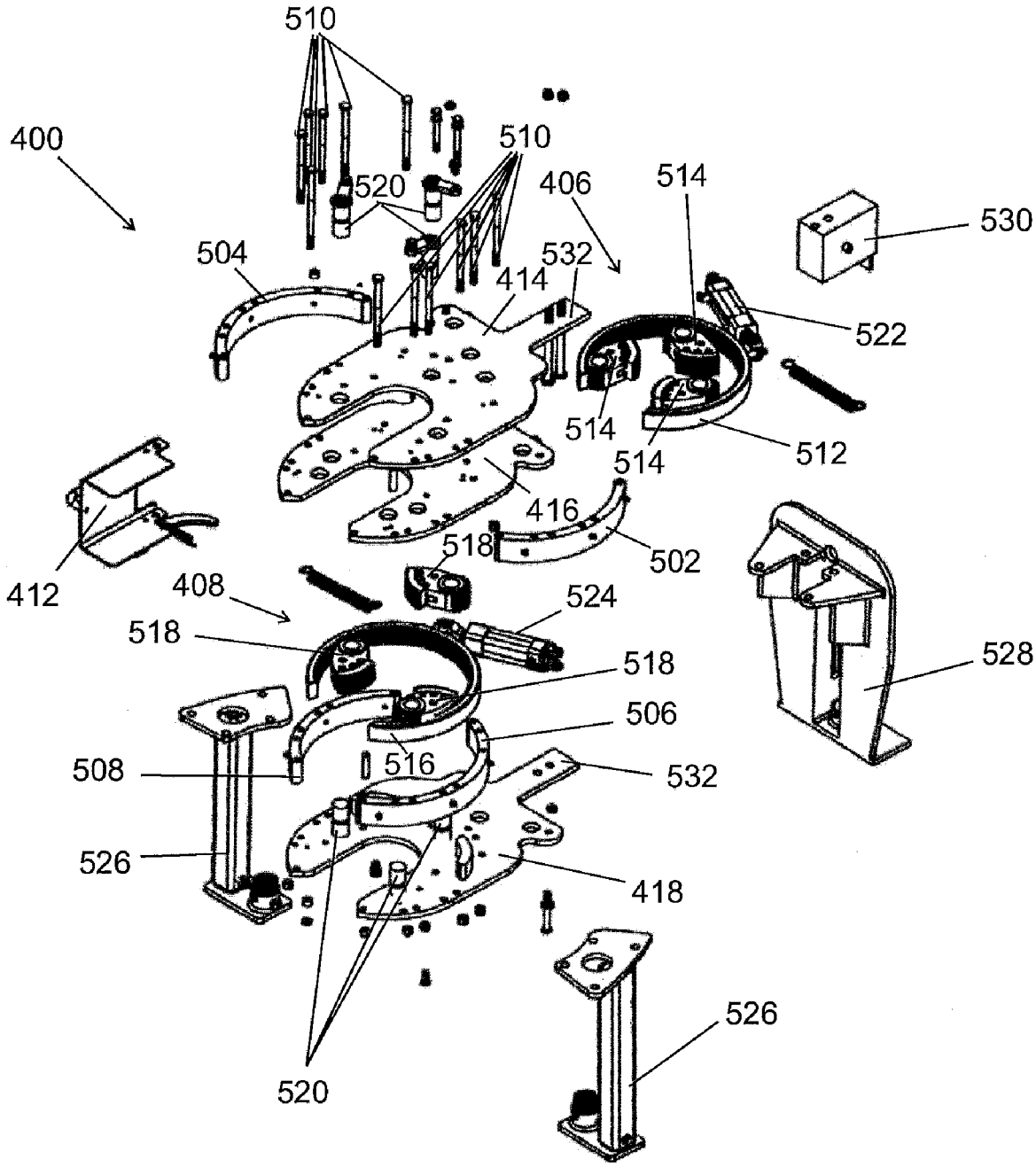
FIG. 5 is an exploded view of the reversible torque open head back-up tong of FIG. 4.

FIG. 5 is an exploded view of the reversible torque open head back-up tong 400 of FIG. 4. FIG. 5 better illustrates the construction of the reversible torque open head back-up tong 400, including the upper and lower gripping mechanisms 406, 408. The upper, lower and intermediate plates 414, 416 and 418 are spaced apart by four radial spacers, 502, 504, 506, 508. The upper radial spacers 502 and 504 are positioned on opposing sides of the back-up tong 400 between the top plate 414 and intermediate plate 416, and the lower radial spacers 506 and 508 are similarly positioned on opposing sides of the back-up tong 400 between the intermediate plate 416 and the bottom plate 418. All four spacers are held in compression between the three plates 414, 416 and 418 by bolts 510 extending through aligning holes in the plates 414, 416 and 418 and radial spacers 502, 504, 506 and 508.

Figure 8:
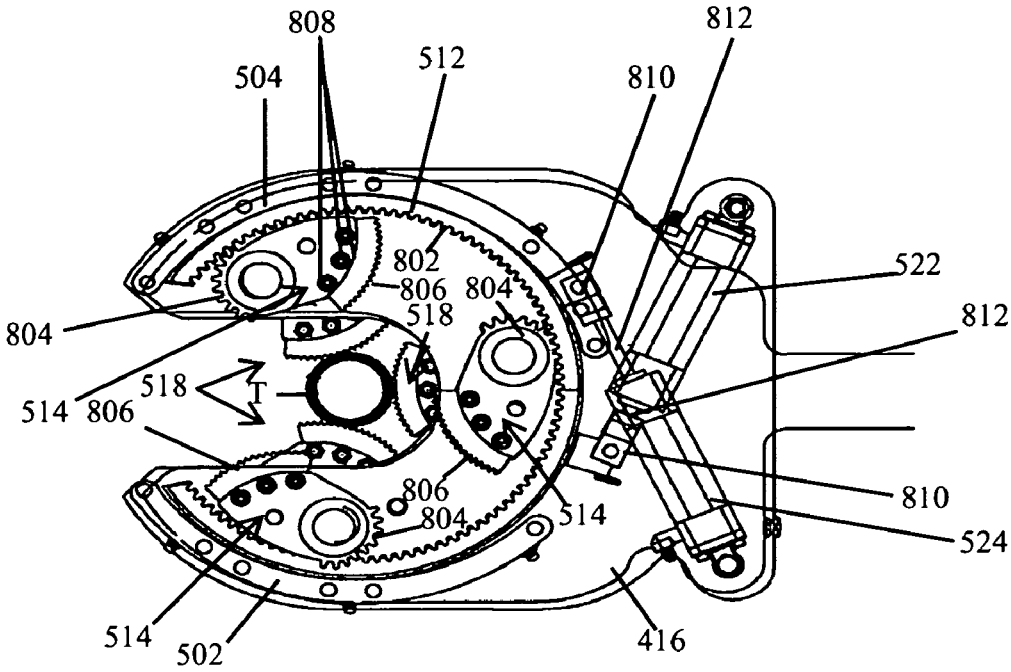
FIG. 8 is a top view of the reversible torque open head back-up tong of FIG. 6 with the top plate removed exposing the upper jaws of the upper gripping mechanism in the disengaged position and the lower jaws of the lower gripping mechanism in the engaged position.
Figure 9:
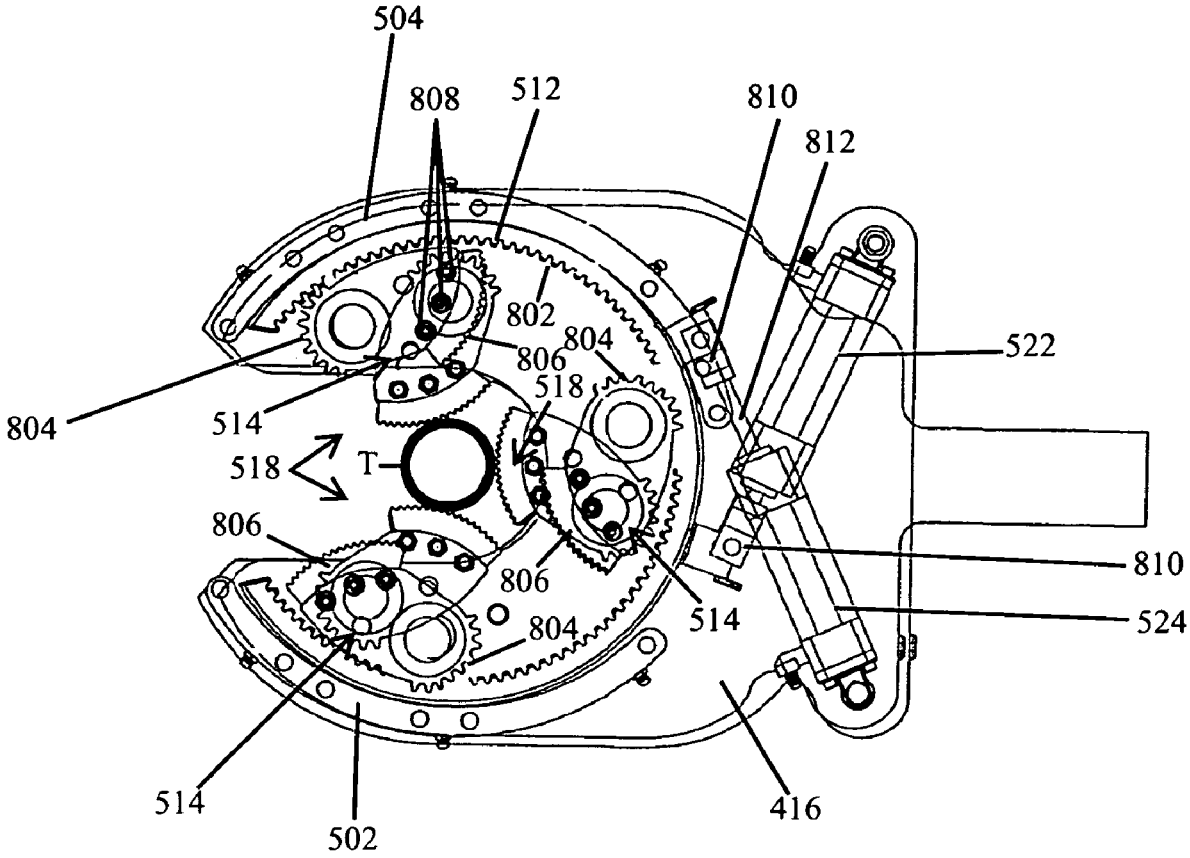
FIG. 9 is a top view of the reversible torque open head back-up tong of FIG. 6 with the top plate removed exposing the upper jaws of the upper gripping mechanism in the disengaged position, the lower jaws of the lower gripping mechanism in the engaged position and further illustrating the lower jaws of the lower gripping mechanism in phantom lining.
Figure 10:
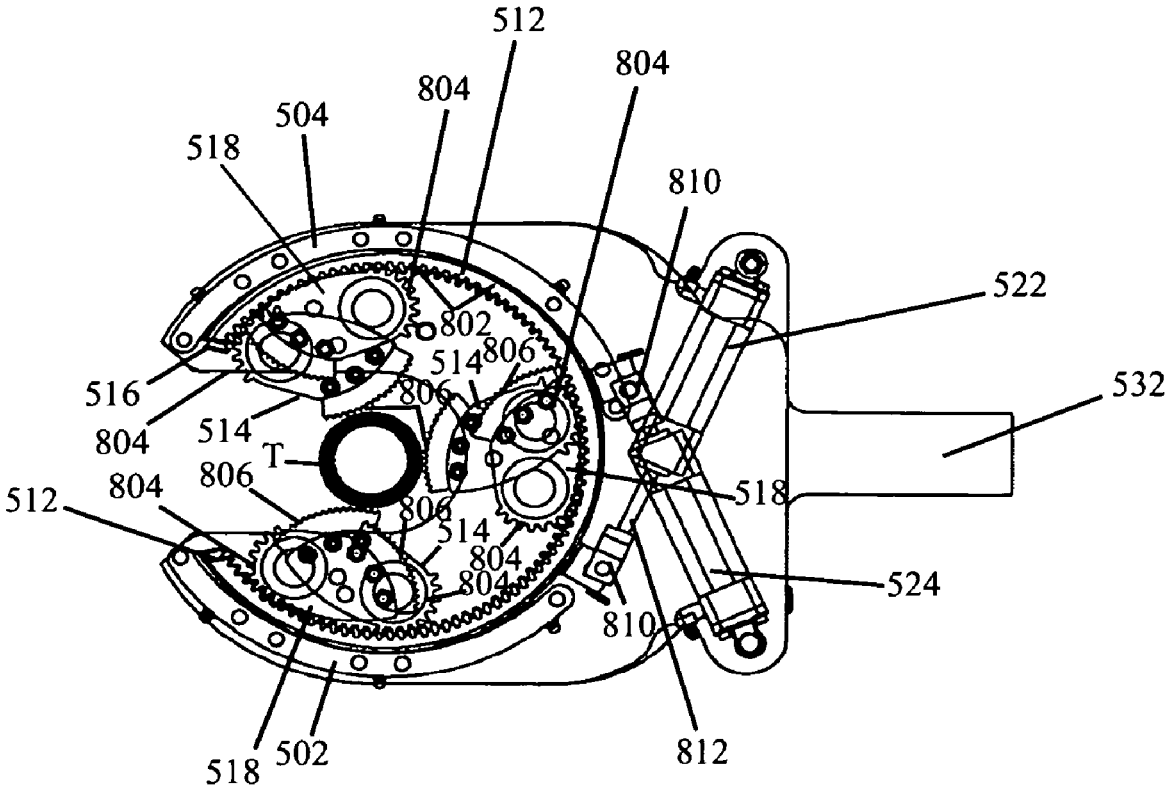
FIG. 10 is a top view of the reversible torque open head back-up tong of FIG. 6 with the top plate removed exposing the upper jaws of the upper gripping mechanism in the engaged position, the lower jaws of the lower gripping mechanism in the disengaged position and further illustrating the lower jaws of the lower gripping mechanism in phantom lining.

The upper gripping mechanism 406 includes an upper circular ring gear 512 having a gap for alignment with the radial slot 410 in the tong head 404 (see FIG. 1) to allow the back-up tong 400 to receive the tubing through the radial slot 410. The upper ring gear 512 has an outer circumference that slides tangentially along the upper radial spacers 502 and 504, whereas the inner circumference of the upper ring gear 512 includes teeth 802 for engagement of the toothed end 804 of upper jaws 514 (as illustrated in FIGS. 8-10 below).

Similarly, the lower gripping mechanism 408 includes a lower circular ring gear 516 having a gap for alignment with the radial slot 410 in the tong head 404 (see FIG. 1) to allow the back-up tong 400 to receive the tubing through the radial slot 410. The lower ring gear 516 has an outer circumference that slides tangentially along the lower radial spacers 506 and 508, whereas the inner circumference of the lower ring gear 516 includes teeth 802 for engagement of the toothed end 804 of lower jaws 518 (as illustrated in FIGS. 8-10 below).

Both the upper and lower jaws 514 and 518 are mounted through aligning holes in the upper and lower jaws 514 and 518 by pivot rods 520. The aligning holes in the upper jaws 514 are offset from the aligning holes in the lower jaws 518, as shown in the intermediate plate 416. Each ring gear 512 and 516 turns freely about its center in sliding contact with the radial spacers 502, 504 and 506, 508 respectively. Each ring gear 512 and 516 is driven by a hydraulically or pneumatically actuated cylinder 522, 524. Each cylinder 522, 524 is pivotally connected to its respective ring gear 512, 516, and upon actuation of the cylinders 522, 524 the respective ring gears 512, 516 are rotated, causing the respectively engaged jaws, 514, 518 to extend outward and grip a centrally located tube or pipe T, as will be further described in connection with FIGS. 8-10 below.

Figure 1:
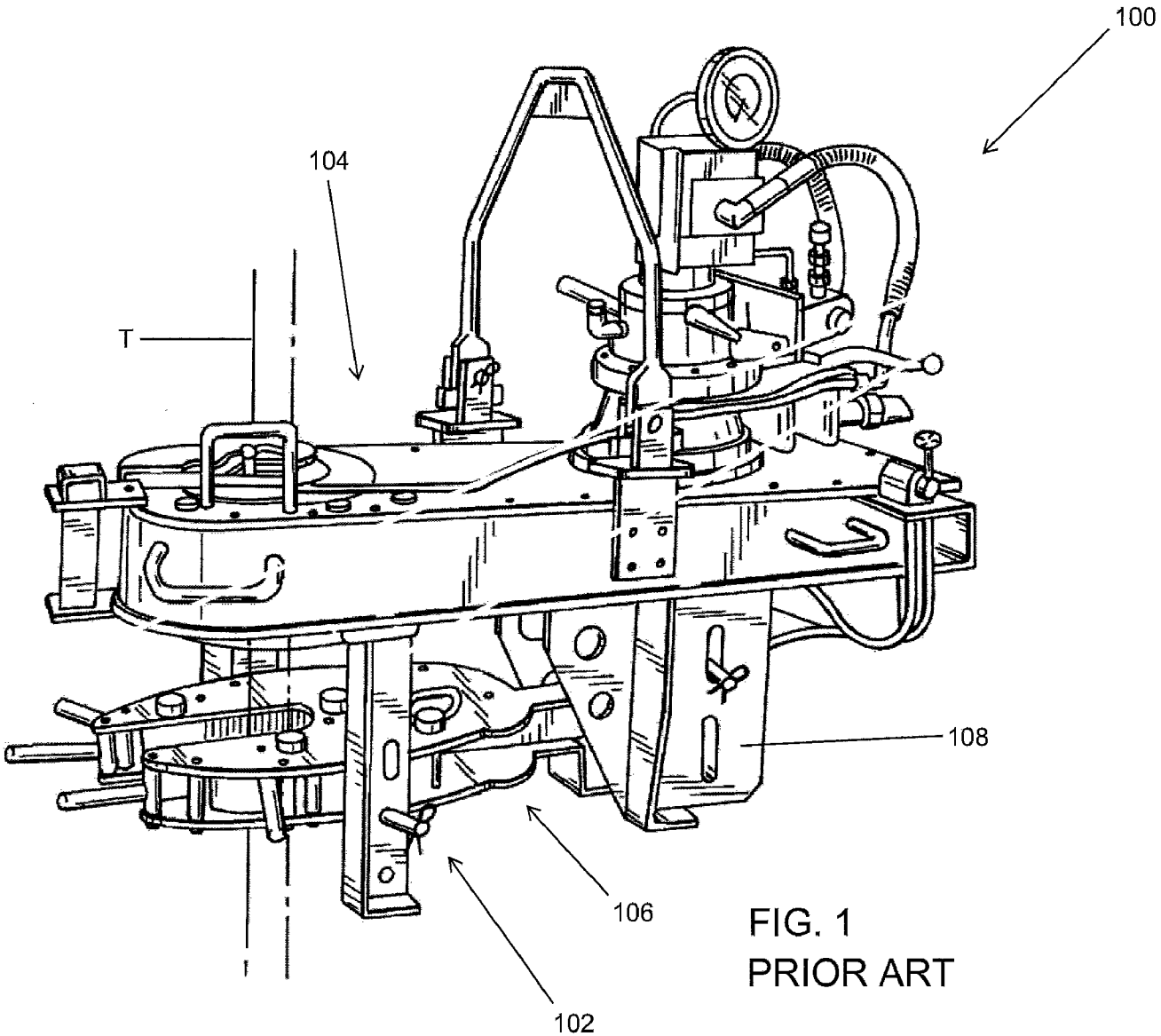
FIG. 1 PRIOR ART
FIG. 1 is a perspective view of a typical prior art power/back-up tong combination device, with tubing captive in both tongs indicated in phantom lining.

In operation, the back-up tong 400 is suspended underneath a power tong, similar to the power tong 104 illustrated in FIG. 1. FIG. 5 includes illustrations of the structures utilized to suspend the back-up tong 400 underneath the power tong. For example, front suspension supports 526 are provided for attachment underneath the power tong for supporting the tong head 404. The front suspension supports 526 are attached to axially align the through bore 402 of the back-up tong 400 with the through bore of the power tong. Further, the power tong and back-up tong 400 are fixed at their ends by connecting support 528. The back-up tong 400 is secured to the connecting support 528 via a suspension block 530 that is bolted to the stem 532 of the back-up tong 400 as well as the connecting support 528.

Figure 6:
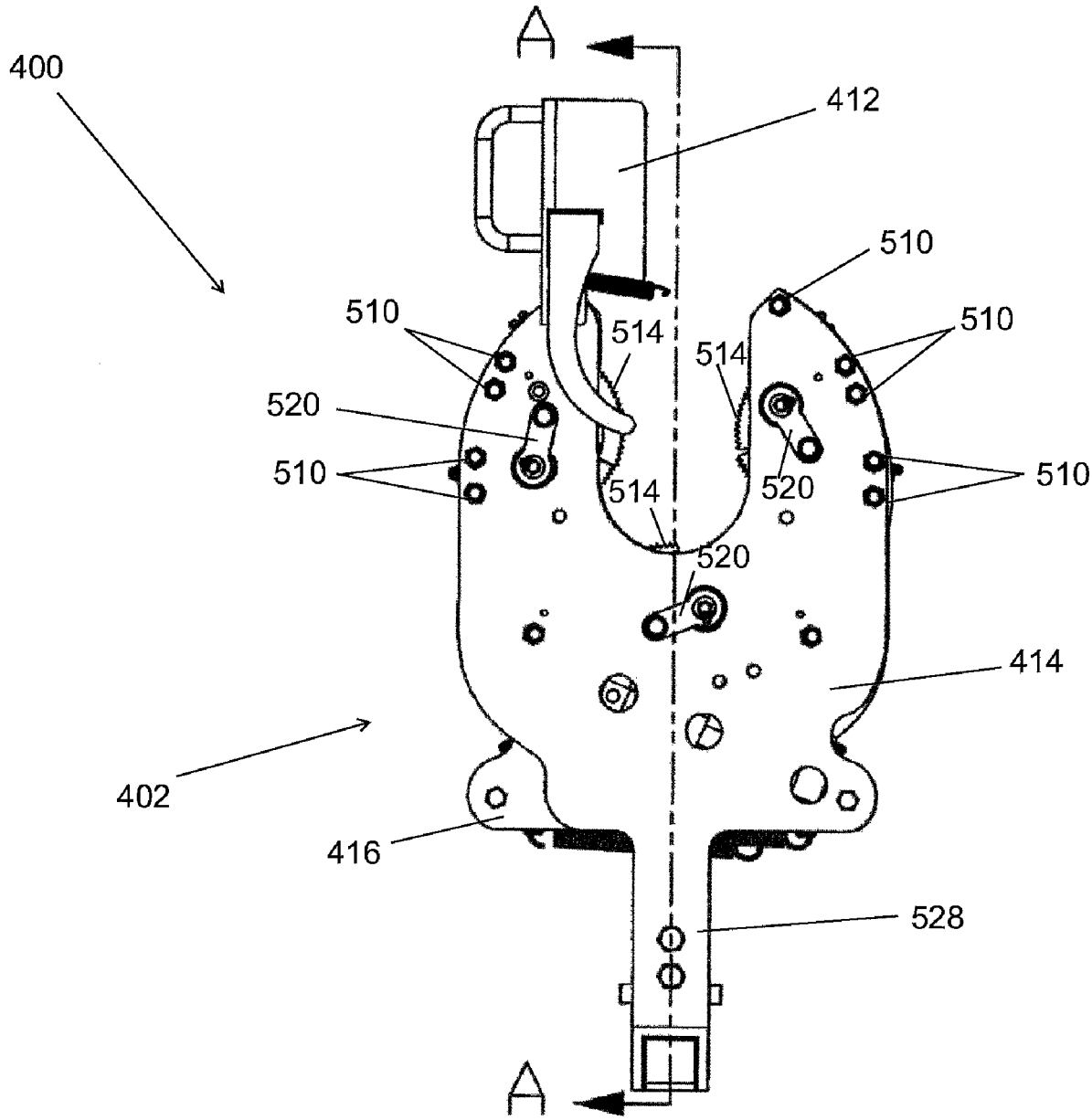
FIG. 6 is a top view of the reversible torque open head back-up tong of FIG. 4.

FIG. 6 is a top view of the reversible torque open head back-up tong 400 of FIG. 4. The structure of the top plate 414 of the tong head 404, hinged latch 412 and stem 532 are all clearly illustrated in this view. The intermediate plate 416 is also illustrated protruding from under the left side of the top plate 414. The upper jaws 514 are also visible, as well as the upper pivot rods 520 pivotally securing the upper jaws 514 between the top plate 414 and the intermediate plate 416. The bolts 510 that hold the top, intermediate and bottom plates 414, 416 and 418 in compression with the radial spacers 502, 504, 506 and 508 are also illustrated.

Figure 7:
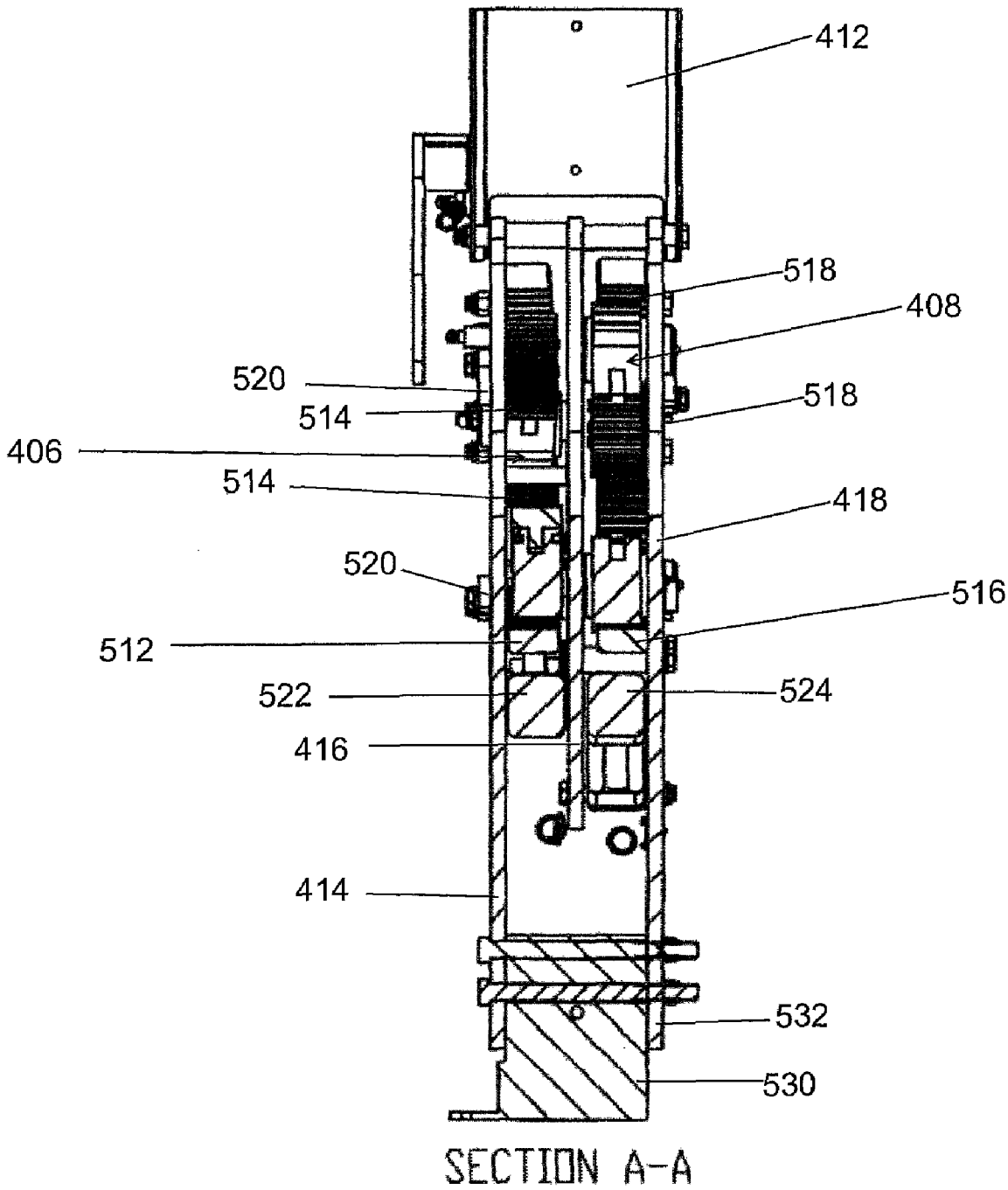
FIG. 7 is a cross-sectional view of the reversible torque open head back-up tong taken along line A-A of FIG. 6.

FIG. 7 is a cross-sectional view of the reversible torque open head back-up tong 400 taken along line A-A of FIG. 6. FIG. 7 clearly illustrates the separation of the upper gripping mechanism 406 from the lower gripping mechanism 408 by the intermediate plate 416. Two of the upper jaws 514 of the upper gripping mechanism 406 are shown positioned between the top plate 414 and intermediate plate 416. Two additional lower jaws 518 are also shown positioned between the intermediate plate 416 and the bottom plate 418. The upper ring gear 512 is also shown driven by pivotal attachment to the upper cylinder 522 and the lower ring gear 516 is shown driven by the pivotal attachment to the lower cylinder 524. Pivot rods 520, hinged latch 412, the stem 532 and suspension block 530 are also illustrated in this cross-sectional view.

FIGS. 8-10 illustrate the operation of the reversible torque open head back-up tong 400 shown in FIGS. 4-7. In particular, FIGS. 8 and 9 illustrate the lower jaws 518 of the lower gripping mechanism 408 in the engaged position and the upper jaws 514 of the upper gripping mechanism 406 in the disengaged position. FIG. 10, on the other hand, illustrates the upper jaws 514 of the upper gripping mechanism 406 in the engaged position and the lower jaws 518 of the lower gripping mechanism 408 in the disengaged position.

FIGS. 8-10 further illustrate the upper and lower jaws 514 and 518 and engagement of the jaws 514 and 518 by the upper and lower ring gears 512 and 516. Each jaw 514 and 518 has a toothed end 804 that is in mesh with the teeth 802 on the inner circumference of the respective ring gears 512 and 516. The opposite end of each jaw 514 and 518 includes a jaw insert 806 having a circularly curved jaw face. Each jaw insert 806 is removably secured to the jaws 514 and 518 by, for example, bolts 808.

The angular movement of the ring gears 512 and 516 is guided by the radial spacers 502, 504, 506 and 508. Further, the ring gears 512 and 516 are circumferentially contained against spreading at their free ends by the radial spacers 502, 504, 506 and 508. Each radial spacer 502, 504, 506 and 508 acts against the radially outward reactive force acting on the ring gears 512 and 516 upon engagement of the jaws 514 or 518 with a tube T. In this regard, the radial spacers 502, 504, 506 and 508, acting in cooperation with the bolts 510 serve to join the plates 414, 416, 418, maintain the positioning of the ring gears 512 and 516 about a center of rotation concentric with the radial slot 410, and providing structural back-up to prevent the ring gears 512 and 516 from spreading under operating stress.

FIG. 8 is a top view of the reversible torque open head back-up tong of FIG. 6 with the top plate 414 removed exposing the upper jaws 514 of the upper gripping mechanism 406 in the disengaged position and the lower jaws 518 of the lower gripping mechanism 408 in the engaged position. As illustrated in FIG. 8, with the top plate 414 removed, the intermediate plate 416, the upper jaws 514, the upper ring gear 512 and the upper radial spacers 502 and 504 are exposed. An actuating rod 812 of the pneumatic or hydraulically powered upper cylinder 522 is pivotally attached to the upper ring gear 512 at an upper ring tab 810 extending from the upper ring gear 512. Similarly, actuating rod 812 of the pneumatic or hydraulically powered lower cylinder 524 is pivotally attached at a lower ring tab 810 extending from the lower ring gear 516, as illustrated by phantom lines.

As shown in FIG. 8, when the lower cylinder 524 is actuated, the actuating rod 812 extends from the lower cylinder 524. The lower ring gear 516 responds to the torque from the lower cylinder 524 by rotating relative to the plates 414, 416, 418 to a position illustrated in FIG. 8. As the lower ring gear 516 rotates, it causes each of the lower jaws 518 to turn in a counter-clockwise direction about their respective pivots, moving the lower jaws 518 from a retracted position, as illustrated in FIG. 4 and FIG. 10, to a gripping position shown in FIG. 8. A tube T placed in the radial slot 410 of the tong head 404 and positioned concentrically with the ring gears 512 and 516 is engaged at three circumferentially spaced locations by the three jaw faces 806 of the lower jaws 518.

FIG. 9 is a top view of the reversible torque open head back-up tong of FIG. 6 with the top plate 414 removed exposing the upper jaws 514 of the upper gripping mechanism 406 in the disengaged position, the lower jaws 518 of the lower gripping mechanism 408 in the engaged position and further illustrating the lower jaws 518 of the lower gripping mechanism 408 in phantom lining. FIG. 9 shows the same operational position of the jaws 514 and 518 in FIG. 8, except that the lower gripping mechanism 408 is visible in phantom lines under the intermediate plate 416.

FIG. 10 is a top view of the reversible torque open head back-up tong of FIG. 6 with the top plate 414 removed exposing the upper jaws 514 of the upper gripping mechanism 406 in the engaged position, the lower jaws 518 of the lower gripping mechanism 408 in the disengaged position and further illustrating the lower jaws 518 of the lower gripping mechanism 408 in phantom lining. As shown in FIG. 10, when the upper cylinder 522 is actuated, the actuating rod 812 of the upper cylinder 522 extends from the upper cylinder 522. The upper ring gear 512 responds to the torque from the cylinder 522 by rotating relative to the plates 414, 416, 418 to a position illustrated in FIG. 10. As the upper ring gear 512 rotates, it causes each of the upper jaws 514 to turn in a clockwise direction about their respective pivots (which is the opposing direction of the lower jaws 518 when actuated), moving the upper jaws 514 from a retracted position, as illustrated in FIGS. 4, 8 and 9, to a gripping position shown in FIG. 10. A tube T placed in the radial slot 410 of the tong head 404 and positioned concentrically with the ring gears 512 and 516 is engaged at three circumferentially spaced locations by the three jaw faces 806 of the upper jaws 514.

In one example implementation of the invention, the jaws 514 and 518 may be removable and more than one set of jaws 514 and 518 may be provided that are sized and configured for gripping a range of tube diameters. For example, one set of jaws 514 and 518 may be shaped to extend further in a radially inward direction towards the center of the ring gears 512 and 516 for engaging a range of smaller diameter tubes. Various jaw inserts can also be provided to cover substantially the entire range of tube diameters normally encountered in oil and gas well bores.

Although FIGS. 4-10 illustrate an implementation of a back-up tong 400 actuated by pneumatic or hydraulic cylinders 522 and 524, an implementation of the back-up tong can be constructed for manual operation by eliminating the drive cylinders 522 and 524, associated hoses and fluid conduits, and adding gear handles for manually rotating the ring gears 512 and 516. Optionally, return springs may also be provided to bias the ring gears 512 and 516 to their retracted positions. Further, although FIGS. 4-10 illustrate an open faced back-up tong, the back-up tong 400 may be a closed faced tong without departing from the invention.

Figure 2:
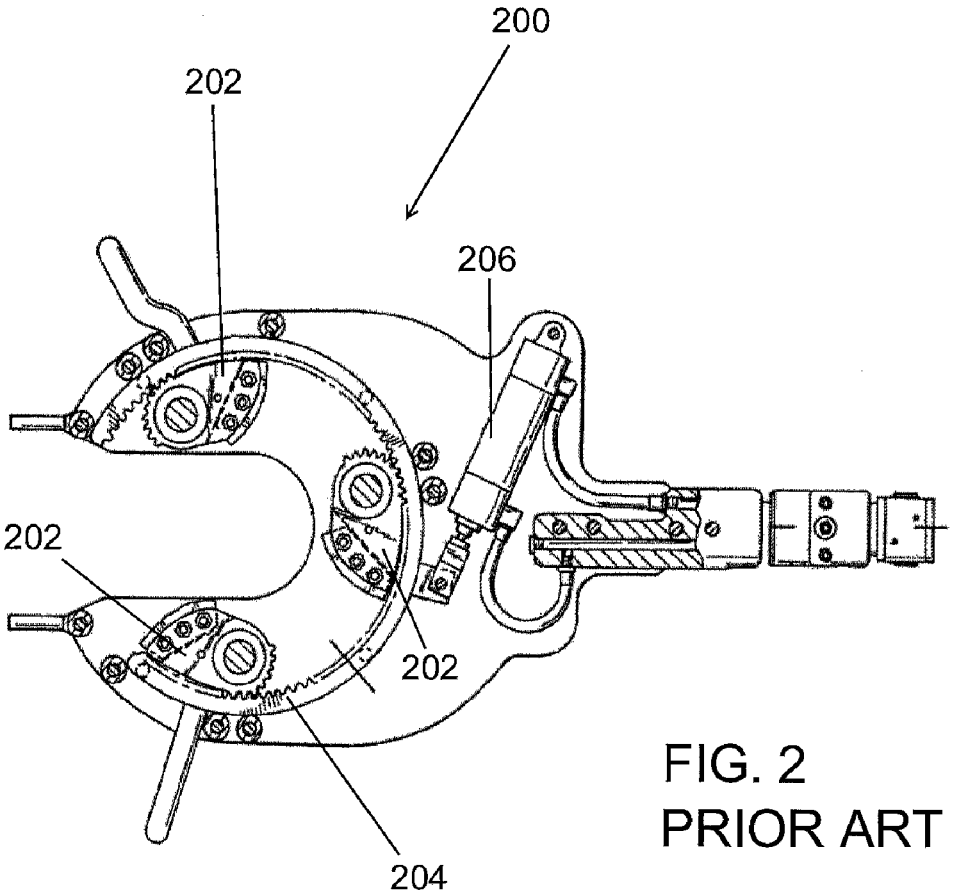
FIG. 2 PRIOR ART
FIG. 2 is a top view of a typical prior art open-head Foster-style back-up tong with the top plate of the housing removed to expose the jaws of the tube gripping mechanism in the disengaged position.
Figure 3:
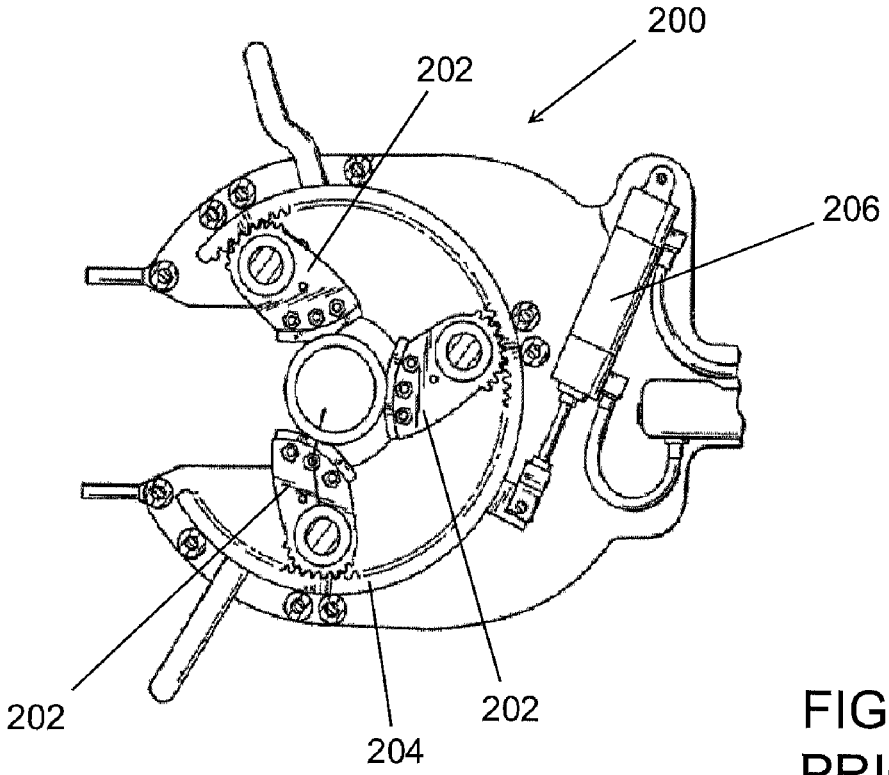
FIG. 3 PRIOR ART
FIG. 3 is a top view of the prior art back-up tong in FIG. 2 illustrating the jaws of the tube gripping mechanism in the engaged or gripping position.

Using pneumatic or hydraulic cylinders 522 and 524 to move a gripping mechanism such as the gripping mechanism shown in prior art FIGS. 2 and 3 are known in the art. Thus, the connection of the back-up tong 400 and associated cylinders 522 and 524 to a pressurized pump and associated control valves via external hoses need not be discussed in any detail.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A back-up tong for assembling or disassembling threaded tubing joints, comprising:

a first gripping mechanism;

a second gripping mechanism;

the first gripping mechanism having a first plurality of jaws for engaging a tubing to prevent rotation of the tubing in a clockwise direction; and the second gripping mechanism having a second plurality of jaws for engaging the tubing to prevent rotation of the tubing in a counter-clockwise direction;

a first plate, a second plate, and a third plate, where the first gripping mechanism is housed between the first and second plates and where the second gripping mechanism is housed between the second and third plates, and where each jaw in the first plurality of jaws is pivotally connected to the first and second plates and at least one jaw in the second plurality of jaws is connected to the second plate.

2. The back-up tong of claim 1, where the first gripping mechanism further includes a first rotatably mounted ring gear in mesh with the jaws in the tint plurality of jaws.

3. The back-up tong of claim 1, where the second ripping mechanism further includes a second rotatably mounted ring gear in mesh with the jaws in the second plurality of jaws.

4. The back-up tong of claim 1, where each jaw in the second plurality of jaws is pivotally connected to second and third plates.

5. The back-up tong of claim 1, where each jaw in the first plurality of jaws is pivotally connected to the first and second plates and each jaw in the second plurality of jaws is pivotally connected to the second and third plates, and where each jaw of the first plurality of jaws has a pivot point and each jaw of the second plurality of jaws has a pivot point and where the pivot point of each jaw in the first plurality of jaws is axially offset from the pivot points of each jaw in the second plurality of jaws.

6. The back-up tong of claim 5 where each jaw in the first plurality of jaws is pivotally connected by a pivot pin extending through aligning holes in the first and second plates and the jaws in the first plurality of jaws, and where each jaw in the second plurality of jaws is pivotally connected by a pivot pin extending through aligning holes in the second and third plates and the jaws in the second plurality of jaws.

7. A back-up tong for assembling or disassembling threaded tubing joints, comprising:

a tong head having a top plate, an intermediate plate and a bottom plate, a first gripping mechanism positioned between the top and intermediate plates;

a second gripping mechanism positioned between the intermediate and bottom plates;

the first gripping mechanism having a first ring gear rotatably mounted between the top and intermediate plates and a plurality of first jaws pivotally connected to the top and intermediate plates and in mesh with the first ring gear such that rotation of the first ring gear pivots the first jaws between a retracted position and a gripping position; and the second gripping mechanism having a second ring gear rotatably mounted between the intermediate and bottom plates and a plurality of second jaws pivotally connected to the intermediate and bottom plates and in mesh with the second ring gear such that rotation of the second ring gear pivots the second jaws between a retracted position and a gripping position.

8. The back-up tong of claim 7, where the first jaws each have a toothed end in mesh with the first ring gear and where the second jaws each have a toothed end in mesh with the second ring gear.

9. The back-up tong of claim 8, where both the first and second ring gears have teeth along an interior circumference for meshing with the first jaws and second jaws respectively.

10. The back-up tong of claim 7 where an outer circumference of the first ring gear is supported by at least two radial spacers mounted to the top plate.

11. The back-up tong of claim 7 where an outer circumference of the second ring gear is supported by at least two radial spacers mounted to the bottom plate.

* * * * *